United States Patent [19]

Hartshorn

[11] 4,424,510

[45] Jan. 3, 1984

[54] FIRE ALARM SYSTEM

[76] Inventor: Lawrence L. Hartshorn, 214 Silver Spring St., Providence, R.I. 02904

[21] Appl. No.: 201,133

[22] Filed: Oct. 27, 1980

[51] Int. Cl.[3] ..... G08B 25/00

[52] U.S. Cl. ..... 340/304; 340/308

[58] Field of Search ..... 340/304, 303, 307, 308, 340/309

[56] References Cited

U.S. PATENT DOCUMENTS 3,531,794 9/1970 Goerner ..... 340/308 X 3,996,580 12/1976 Di Paula, Jr. et al. ..... 340/304

*Primary Examiner*—Thomas A. Robinson

*Assistant Examiner*—Daniel Myer

*Attorney, Agent, or Firm*—Barlow & Barlow

[57] ABSTRACT

The invention relates to a fire alarm system in which the fire alarm is located in an enclosure which must be entered by the operator of the fire alarm, and the door to the enclosure, or opening through which the operator passes, must be closed in order to initiate the actuation of the fire alarm. The fire alarm within the enclosure has a fire alarm switch located to be covered by a door or plate which must be moved in order to have access to the fire alarm switch. Circuits are provided which upon the closing of the door cause a circuit to be energized while the movement of the cover for the alarm switch allows the alarm switch lever to be moved only if the operator is located in the enclosure containing the fire alarm. The alarm switch actuates a door lock and a timing device which will hold the operator within the enclosure for a given length of time sufficient for the firemen to reach the scene of the alarm.

4 Claims, 8 Drawing Figures

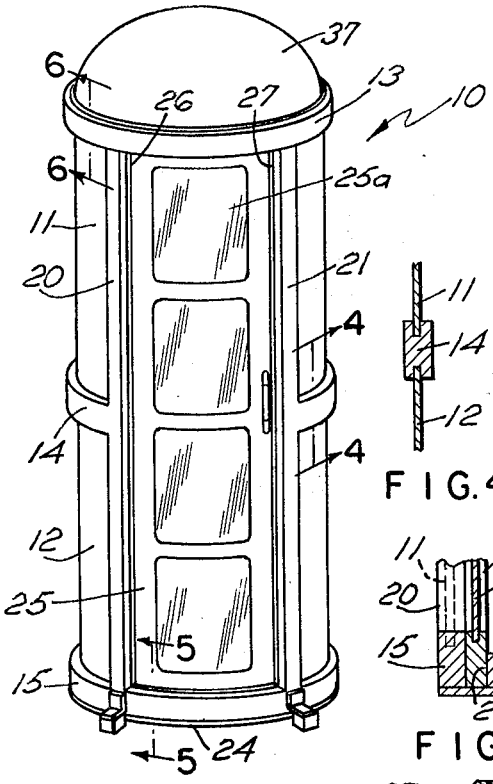
FIG. 1
FIG. 4
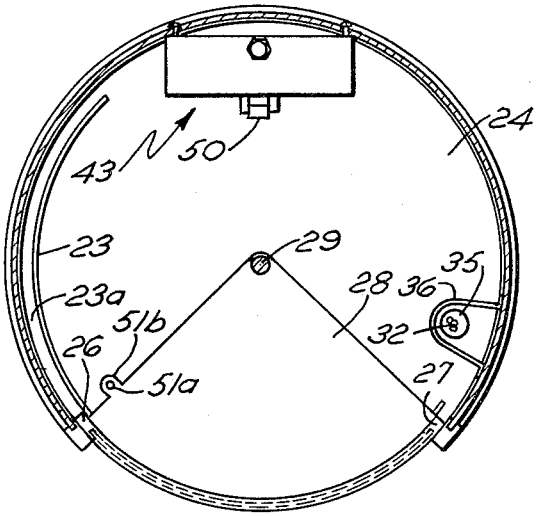
FIG. 2
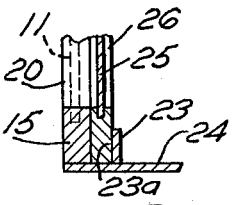
FIG. 5
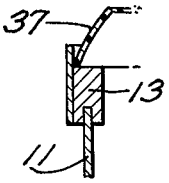
FIG. 6
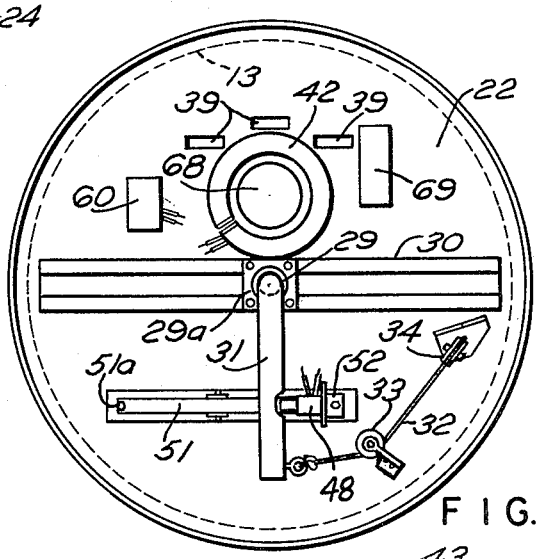
FIG. 3
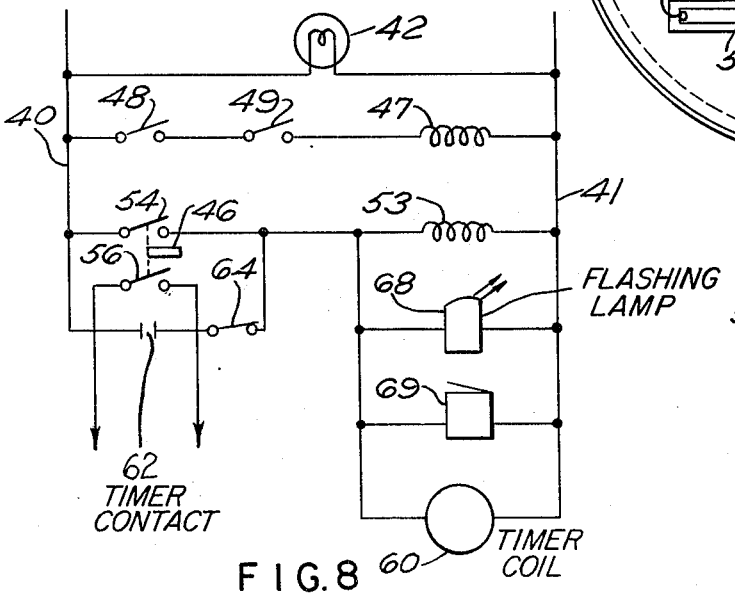
FIG. 8
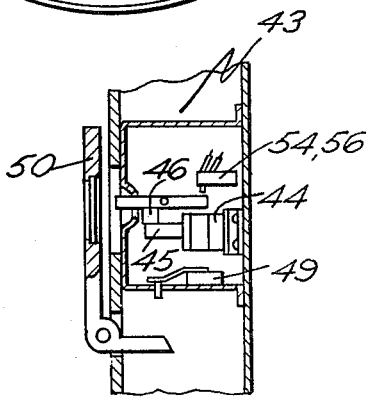
FIG. 7

FIRE ALARM SYSTEM

BACKGROUND OF THE INVENTION

This invention relates to a fire alarm device, and more particularly to a fire alarm device disposed in a public place for operation by members of the public as conditions require, such device being provided with mechanism for temporarily detaining the operator of the alarm device at the alarm box or actuating location.

The concept of this device is based upon the recognized premise and suggested procedure from most American fire departments that upon actuation of a public fire alarm call, the caller should wait by the alarm box until the fire engines arrive in order that he can then direct the firemen to the exact location of the fire, thus the firemen are enabled by direct means to know exactly where the fire is located without losing precious time.

The enforced waiting period encompassed within this invention thus serves two purposes: It teaches the need for remaining at the fire alarm device, and it also discourages the potential false alarmist from activating an alarm from which there is no quick escape route. These thoughts have been encompassed in prior patent, more particularly in U.S. Pat. No. 4,060,800 in which there is a time delay incorporated for holding the door of the cage in which the alarm box is located closed for a predetermined length of time. The present disclosure, however, differs in that there is a cover for the alarm device which must be moved to actuate the fire alarm circuit which in turn locks the enclosure door and a different scheme of operation is involved. Other devices embodying some of these general thoughts are found in the following U.S. Pat. Nos. 1,217,069; 1,267,165; 3,886,537; 3,905,027; 3,964,057; 3,996,580; and 4,027,304.

SUMMARY OF THE INVENTION

An enclosure generally cylindrical in shape is formed from sheet metal and posts having slots therein that receive the sheet metal, and is provided with a sliding door or arcuate shape to slide within the cylindrical shape of the main enclosure to actuate a circuit closing switch for accomplishing different electrical functions. There is a switch which is closed upon closing of the closure door which door is urged to closed position by a weight. The location of the fire alarm box or actuating switch within the enclosure is such that the operator of the alarm device must be well within the enclosure in order to reach the alarm box. The door for the enclosure must be completely closed in order that the alarm device function. Further, the alarm device is provided with a cover for the main switch for the alarm device and this cover must be moved to expose the actual alarm switch.

The movement of the cover also permits manual movement of the alarm switch and closing the alarm switch circuit actuates a lock for the door for the enclosure. The alarm switch when closed also actuates a timing device to prevent the door lock from being withdrawn for a certain length of time, presumably that length of time in which the fire apparatus will reach the location of the alarm device.

BRIEF DESCRIPTION OF THE DRAWINGS

FIG. 1 is a perspective view of the enclosure in which the fire alarm pull box is located;

FIG. 2 is a sectional view taken above the door and below the top wall of the enclosure;

FIG. 3 is a top view of the enclosure with the dome on top removed to show the operating mechanism mounted on the top wall of the enclosure;

FIG. 4 is a sectional view on substantially line 4—4 of FIG. 1;

FIG. 5 is a section on substantially line 5—5 of FIG. 1;

FIG. 6 is a section on line 6—6 of FIG. 1;

FIG. 7 is a diagramatic view largely in elevation of the inner mechanism of the fire alarm box;

FIG. 8 is a schematic electrical diagram of the circuitry involved.

DESCRIPTION OF THE PREFERRED EMBODIMENT

The enclosure device is generally cylindrical in form and is of a height into which a person may walk. Sheet metal sections 11 and 12 fit into frames 13, 14 and 15 at the top, intermediate and bottom locations of the generally cylindrical form by entering slots in these frames which serve to maintain the arcuate form of these sections. A single section encompasses about 270° of a circle and at the opposite edges of these sections, the sheet metal edges fit into slots in risers 20 and 21 leaving an opening between the risers which may be entered by the operator of an alarm device within. Top wall 22 and bottom wall 24 are also provided. This opening between the risers 20, 21 is closed by a door 25 which is also arcuate in form on substantially the same arc of a circle as the sections 11 and 12 and which is supported on its vertical edges (FIG. 2) by frames 26 and 27 and is provided with windows **25*a* spaced vertically along the door. This door has a top pie-shaped plate 28 (FIG. 2) of a little over 90° and rising from this plate there is a post 29 which is supported in a top wall 22 for the cylindrical enclosure and projects above the wall 22 sufficiently to receive certain operating mechanism. Radial braces 30 on the top wall provide rigidity for the bearing 29*a* that receives post 29. Upon this post and extending radially is arm 31 which has a flexible cord 32 passing over pulleys 33 and 34 with a weight 35 to swing this arm fixed to the post 29, and above the top wall 22 moving the door from open to closed position. This weight is housed by a shield 36 within the enclosure and is not accessible from the outside or inside of the enclosure. The enclosure also has a bottom plate 24 engaging frame 15. The frame 15 and guide strip 23 provide an arcuate channel 23*a* in which the lower edge of the door may be guided in its movement from closed to open position. The switches which provide the control above enumerated is housed within a translucent dome 37 on the top of the cylindrical enclosure, the light being shown at 42. Openings 39 in the top wall 22 provide ventilation and light within the enclosure 10**.

Referring now to FIG. 8 there is shown an electrical schematic for the device. Briefly, voltage is supplied across electrical lines 40-41 which illuminate at all times a lamp 42. Within the enclosure there is the alarm pull box 43 (FIG. 7) within which there is located a solenoid 44 which normally has its armature 45 extended to engage or block the movable member of the alarm switch assembly which is an electric switch 48 and an actuating lever 46, the armature 45 acting as an interference means. In a series circuit with the coil 47 of the solenoid 44 is a normally open electric alarm switch 48 which is closed when the lever arm 31 of the assembly engages the same at the position of the enclosure door 11 is closed posture. Also in series with the solenoid coil 47 is a second normally open switch 49 which is closed by the downward movement of the outer cover 50 of the fire alarm box 43 so it will be apparent that when the enclosure door is closed and the handle or cover 50 for the fire alarm box is pulled downwardly, the solenoid preventing operation of the alarm will withdraw its armature 45 so that now the alarm lever 46 may be actuated. As seen in FIG. 3 there is a pivoted lever 51 that carries a locking pin 51*a* at one end and at the other end is a solenoid 52 that has an armature that will pull upwardly on the lever so that the pin will engage keeper 51*b* (FIG. 2) to prevent the opening of the door 25. In series with the coil 53 of the solenoid 52 is a normally open switch 54 which is mechanically coupled to a second switch 56, and to the alarm actuating lever 46. Thus when the alarm is actuated by closing the switches, 54, 56, switch 54 energizes the coil of the door lock solenoid 52, which also actuates the coil 60 of a timer whose contacts 62 are in series with a normally closed switch 64. The arrangement is such that regardless of the position of the alarm switches, the locking door solenoid will remain energized and maintain the door in a closed position, and will only open after a pre-set delay as set into the timing relay, or by the actuation of switch 64. Switch 64 is a key-operated switch on the external portion of the booth which can be actuated by a key held by the police and/or firemen who respond to the alarm. In addition, when the alarm is energized, flashing lamp 68 will be energized as well as a sounder 69, all of which will remain energized until the door of the fire alarm device is opened.

From the above description it will be apparent that one cannot without entering the enclosure actuate a false alarm. For example, if one would reach in through the partially opened door and pull down the cover 50, this will fail to permit the alarm lever 46 to be pulled downwardly as it is necessary for the door to be completely closed in order for the solenoid 44 to have its armature 45 withdraw from an interfering position.

I claim:

1. In a fire alarm system, a fire alarm device for calling assistance comprising a fire alarm actuating switch assembly and a cover therefore;

a mechanism for ensuring the presence of the one who has operated the alarm device at such device for a predetermined length of time, said mechanism comprising an enclosure in which the alarm switch assembly and its cover are mounted, said enclosure having an opening for the entry and exit of said operator of the fire alarm device, the alarm switch assembly being so disposed in the enclosure so that the operator must be within the enclosure before he can operate the alarm switch assembly;

said alarm switch assembly having a movable member adapted to be engaged by the user;

a door for selectively closing said opening, means responsive to at least the partial open position of the door for preventing operation of the fire alarm device unless the door is closed;

means for normally preventing manual movement of the alarm switch assembly comprising an electric solenoid whose armature normally engages the movable member of the switch to prevent movement thereof;

means responsive to a closed door and actuated by the movement of the cover for the fire alarm switch assembly for closing a circuit to remove the engagement of the armature with the movable member of the switch;

means actuated by the operation of the fire alarm switch assembly for locking the door and maintaining the door locked for a predetermined length of time after operation of the fire alarm switch assembly.

2. In a fire alarm system as in claim 1 wherein the means responsive to a closed door is a normally open switch and the means actuated by the movement of the cover for the fire alarm means is a second normally open switch, said switches being in a series circuit with the coil of said solenoid.

3. In a fire alarm system as in claim 2 wherein the means actuated by the operation of the fire alarm means is a third normally open switch and wherein the means maintaining the door locked is a second solenoid, said third switch and the coil of said second solenoid being in a series circuit.

4. In a fire alarm system as in claim 3 wherein the means maintaining the door locked for a predetermined length of time comprises a time delay switch in series with said second solenoid, which time delay switch means is adjustable for a predetermined length of time.

* * * * *